US008785759B2

(12) United States Patent
Iwase et al.

(10) Patent No.: US 8,785,759 B2
(45) Date of Patent: Jul. 22, 2014

(54) ELECTRIC KEYBOARD MUSICAL INSTRUMENT, METHOD EXECUTED BY THE SAME, AND STORAGE MEDIUM

(71) Applicant: Casio Computer Co., Ltd., Tokyo (JP)

(72) Inventors: Hiroshi Iwase, Tokyo (JP); Tomomi Notsu, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/919,963

(22) Filed: Jun. 17, 2013

(65) Prior Publication Data

US 2014/0000443 A1 Jan. 2, 2014

(30) Foreign Application Priority Data

Jun. 27, 2012 (JP) ..... 2012-144581

(51) Int. Cl.
*G10H 7/00* (2006.01)

(52) U.S. Cl.
USPC ..... 84/615; 84/626; 84/649; 84/653

(58) Field of Classification Search
USPC ..... 84/600–603, 615, 626, 649, 653
See application file for complete search history.

(56) References Cited

U.S. PATENT DOCUMENTS 4,402,245 A * 9/1983 Oya et al. ..... 84/617
4,966,051 A * 10/1990 Tajima ..... 84/663
5,044,251 A * 9/1991 Matsuda et al. ..... 84/615
5,094,136 A * 3/1992 Kudo et al. ..... 84/603
5,117,729 A * 6/1992 Kunimoto ..... 84/660
5,177,314 A * 1/1993 Matsuda et al. ..... 84/615
5,189,238 A * 2/1993 Hayakawa ..... 84/609
5,241,129 A * 8/1993 Muto et al. ..... 84/625
5,256,830 A * 10/1993 Takeuchi et al. ..... 84/625
5,313,013 A * 5/1994 Suzuki et al. ..... 84/622
5,347,087 A * 9/1994 Kozuki ..... 84/605
5,373,098 A * 12/1994 Kitayama et al. ..... 84/659
5,376,753 A * 12/1994 Kosugi et al. ..... 84/658
5,426,262 A * 6/1995 Kitayama et al. ..... 84/622
5,428,185 A * 6/1995 Kunimoto et al. ..... 84/658
5,442,130 A * 8/1995 Kitayama et al. ..... 84/661
5,478,968 A * 12/1995 Kitagawa et al. ..... 84/626
5,554,813 A * 9/1996 Kakishita ..... 84/622
5,578,780 A * 11/1996 Wachi ..... 84/659
5,629,490 A * 5/1997 Inaba ..... 84/171
5,959,231 A * 9/1999 Hasebe ..... 84/601
5,981,860 A * 11/1999 Isozaki et al. ..... 84/603
6,096,963 A * 8/2000 Hirano ..... 84/659

(Continued)

FOREIGN PATENT DOCUMENTS

JP 3254062 B2 2/2002

*Primary Examiner* — David S. Warren
(74) *Attorney, Agent, or Firm* — Holtz Holtz Goodman & Chick PC

(57) ABSTRACT

An electric keyboard musical instrument 10 includes: keys 32; third switches 36 that detect that the keys 32 are pressed down to a position x3; various switches 12 to 15 that receive a selection of a kind of tone; and a CPU 21 that executes generating a sound with a tone of the kind received by various switches 12 to 15 in response to the third switch 36 detecting that a key 32 is pressed down to a position x3. The CPU 21 changes a time from when the third switch 36 detects that a key 32 is pressed down to position x3 until sound generation is executed, according to a kind of tone received through the various switches 12 to 15.

6 Claims, 11 Drawing Sheets

(56) References Cited

U.S. PATENT DOCUMENTS

| | | | | |
|---|---|---|---|---|
| 7,420,114 | B1 * | 9/2008 | Vandervoort | 84/613 |
| 7,429,699 | B2 * | 9/2008 | Tajika | 84/626 |
| 8,178,772 | B2 * | 5/2012 | Iwase | 84/661 |
| 2007/0289435 | A1 * | 12/2007 | Tajika | 84/661 |
| 2009/0031886 | A1 * | 2/2009 | Iwase | 84/661 |
| 2012/0227575 | A1 * | 9/2012 | Nakagawa et al. | 84/735 |

* cited by examiner

FIG.11

| KEY NUMBER | 0 | 1 | ··· | 127 |
|---|---|---|---|---|
| DELAY TIME OF ACOUSTIC PIANO (ms) | 100 | 98 | ··· | 3 |
| DELAY TIME OF ELECTRIC PIANO (ms) | 70 | 68 | ··· | 2 |

FIG.12

| VELOCITY RANGE | 1 | 2 | ··· | 127 |
|---|---|---|---|---|
| COEFFICIENT | 2 | 1.88 | ··· | 0.1 |

FIG.13

| KEY NUMBER | 0 | 1 | ··· | 127 |
|---|---|---|---|---|
| DELAY TIME OF ACOUSTIC PIANO (ms) | 100 | 98 | ··· | 3 |
| DELAY TIME OF ELECTRIC PIANO (ms) | 70 | 68 | ··· | 2 |
| DELAY TIME OF ELECTRIC ORGAN (ms) | 0 | 0 | ··· | 0 |
| DELAY TIME OF HARPSICHORD (ms) | 0 | 0 | ··· | 0 |

ELECTRIC KEYBOARD MUSICAL INSTRUMENT, METHOD EXECUTED BY THE SAME, AND STORAGE MEDIUM

This application is based upon and claims the benefit of priority from the prior Japanese Patent Application No. 2012-144581, filed Jun. 27, 2012, and the entire contents of which are incorporated herein by reference.

BACKGROUND OF THE INVENTION

1. Field of the Invention

The present invention relates to an electric keyboard musical instrument, a method executed by the same, and a storage medium.

2. Related Art

A conventional electric keyboard musical instrument can generate musical sounds that imitate musical sounds generated from a plurality of kinds of keyboard musical instruments such as an acoustic piano, an electric piano, an electric organ, a harpsichord, etc. This is because waveforms of musical sounds generated from the abovementioned keyboard musical instruments are stored beforehand, and these waveforms thus stored are read at a speed designated by a key-pressing operation.

Furthermore, conventional keyboard musical instruments change the tone and volume of musical sounds generated in response to a key-pressing speed or strength. On the other hand, electric keyboard musical instruments also detect a key-pressing speed or strength by providing a plurality of contacts having different timing to be turned ON in response to an pressing amount for each key so as to change the tone and volume of musical sounds generated according to a key-pressing speed or strength thus detected.

Such a configuration enables conventional electric keyboard musical instruments to generate sounds which are more similar to musical sounds generated by keyboard musical instruments. Nevertheless, it is still impossible for a performer accustomed to playing actual keyboard musical instruments to play without feeling discomfort with solely such a configuration.

For example, in keyboard musical instruments such as an acoustic piano, an electric piano, etc., it has been known that there is a time lag from the time when a key is pressed down to its end and a hammer thereof operates to the time when the hammer hits a string and a sound is generated. Therefore, a configuration has been proposed also in electric keyboard musical instruments in which a sound is not generated immediately after a key-pressing being reliably made is detected and a sound is generated after a predetermined lapse of time from the detection (for example, refer to Japanese Patent No. 3254062).

It is impossible to provide a sense of musical performance specific to each of several kinds of keyboard musical instruments simply by delaying a timing of sound generation such as in Japanese Patent No. 3254062.

For example, since the range of motion of a hammer of an electric piano is narrower than that of an acoustic piano, it has been known that a time lag from key-pressing until sound generation of an electric piano is relatively short.

In addition, a sound generation start position of an electric organ is shallow as compared to that of a piano. Furthermore, it is configured so that sound generation is started at a position where the depth of a key being pressed is shallow for a high pitch feet sound of an organ and sound generation is started at a position where the depth of a key being pressed is deep for a low pitch feet sound of an organ. On the other hand, since a harpsichord has a structure in which a plectrum that works together with a keyboard strikes a string, it is configured so that a sound of a plectrum returning to touch a string is generated even when releasing a keyboard.

The conventional electric keyboard musical instruments have not been manufactured with consideration for the production of sounds specific to such kinds of keyboard musical instruments. Therefore, a performer accustomed to playing such kinds of keyboard musical instruments could not help playing without feeling discomfort when playing an electric keyboard musical instrument.

SUMMARY OF THE INVENTION

It is an object of the present invention not to impart a performer accustomed to playing a conventional keyboard musical instrument with a feeling of discomfort while playing music.

In order to achieve the abovementioned object, an electric keyboard musical instrument according to an aspect of the present invention includes:

- a keyboard including a plurality of keys;
- a detection unit that detects that any one of the plurality of keys has been pressed;
- a selection unit that selects a tone of a musical sound to be generated from among a plurality of tones;
- a determination unit that determines a sound generation delay time from among a plurality of sound generation delay times in accordance with a tone selected by the selection unit; and
- a sound generation instruction unit that instructs a sound source connected to generate a musical sound of the tone selected by the selection unit, after the lapse of the sound generation delay time determined by the determination unit since the time at which pressing of a key was detected by the detection unit.

Furthermore, a method according to an aspect of the present invention is a method executed by an electric keyboard musical instrument including a plurality of keys, the method including the steps of:

- detecting that any one of the plurality of keys has been pressed;
- selecting a tone of a musical sound to be generated from among a plurality of tones;
- determining a sound generation delay time from among a plurality of sound generation delay times in accordance with a tone selected; and
- instructing a sound source connected to generate a musical sound of the tone selected, after the lapse of the sound generation delay time determined since the time at which pressing of a key was detected.

Furthermore, a storage medium according to an aspect of the present invention is a storage medium encoded with a computer-readable program that enables a computer used as an electric keyboard musical instrument having a keyboard including a plurality of keys to execute the steps of:

- detecting that any one of the plurality of keys has been pressed;
- selecting a tone of a musical sound to be generated from among a plurality of tones;
- determining a sound generation delay time from among a plurality of sound generation delay times, in accordance with a tone selected; and
- instructing a sound source connected to generate a musical sound of the tone selected, after the lapse of the sound generation delay time determined since the time at which pressing of a key was detected.

BRIEF DESCRIPTION OF THE DRAWINGS

FIG. 11 is a view illustrating an example of a delay time table according to an embodiment;

FIG. 12 is a view illustrating an example of a coefficient table according to an embodiment; and FIG. 13 is a view illustrating an example of a delay time table according to an embodiment.

DETAILED DESCRIPTION OF THE INVENTION

Figure 1:
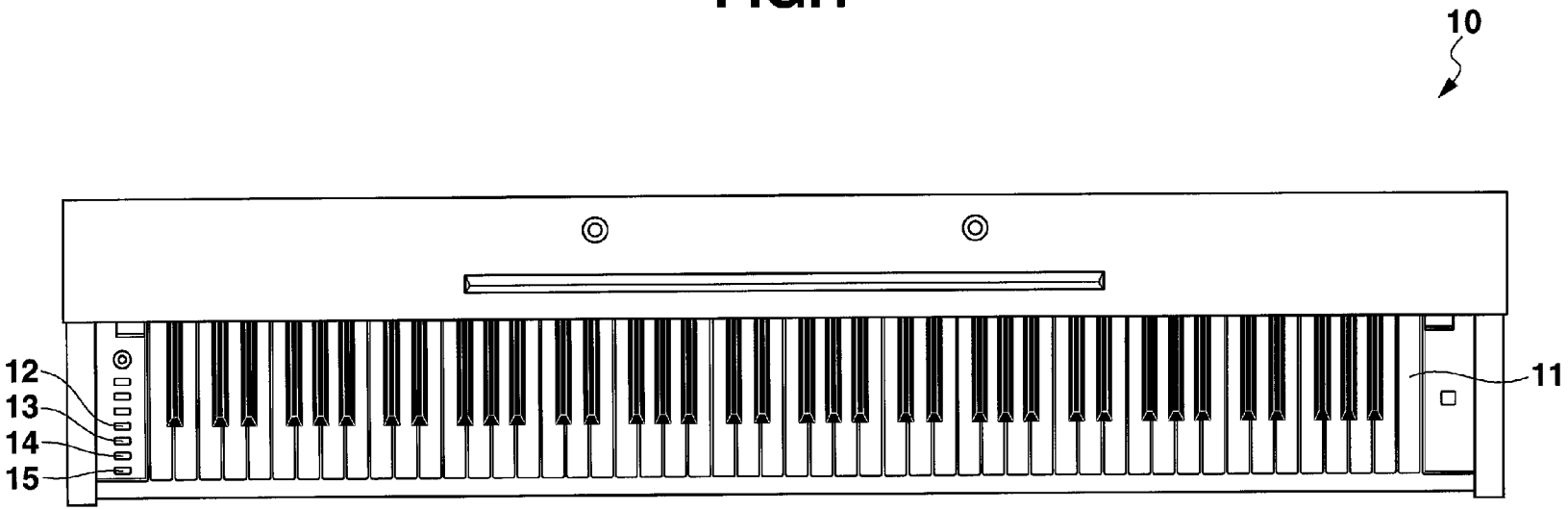
FIG. 1 is a view illustrating a structure of an outer appearance of an electric keyboard musical instrument according to an embodiment.

Embodiments of the present invention are explained in the following with reference to the attached drawings. FIG. 1 is a top view illustrating a structure of an outer appearance of an electric keyboard musical instrument 10 according to the present embodiment.

As illustrated in FIG. 1, a top face of the electric keyboard musical instrument 10 according to the present embodiment is formed in rectangular shape. Hereinafter, a direction of a long side of a rectangle is referred to as a "left-right direction" and a direction of a short side of the rectangle is referred to as an "up-down direction".

A keyboard 11 extends in the left-right direction at a lower part of the top face of the electric keyboard musical instrument 10. A plurality of switches 12 to 15 that receives a selection of a kind of a tone is provided on the left side of the keyboard 11. Each of the plurality of switches 12 to 15 specifically refers to an acoustic piano select switch 12, an electric piano select switch 13, an electric organ select switch 14, and a harpsichord select switch 15. For example, when the acoustic piano select switch 12 is pressed down, an acoustic piano is selected as the kind of a tone.

Furthermore, switches that start and end demonstration musical performances, designate rhythm patterns, and the like, are provided on the left side of the keyboard 11.

Figure 2:
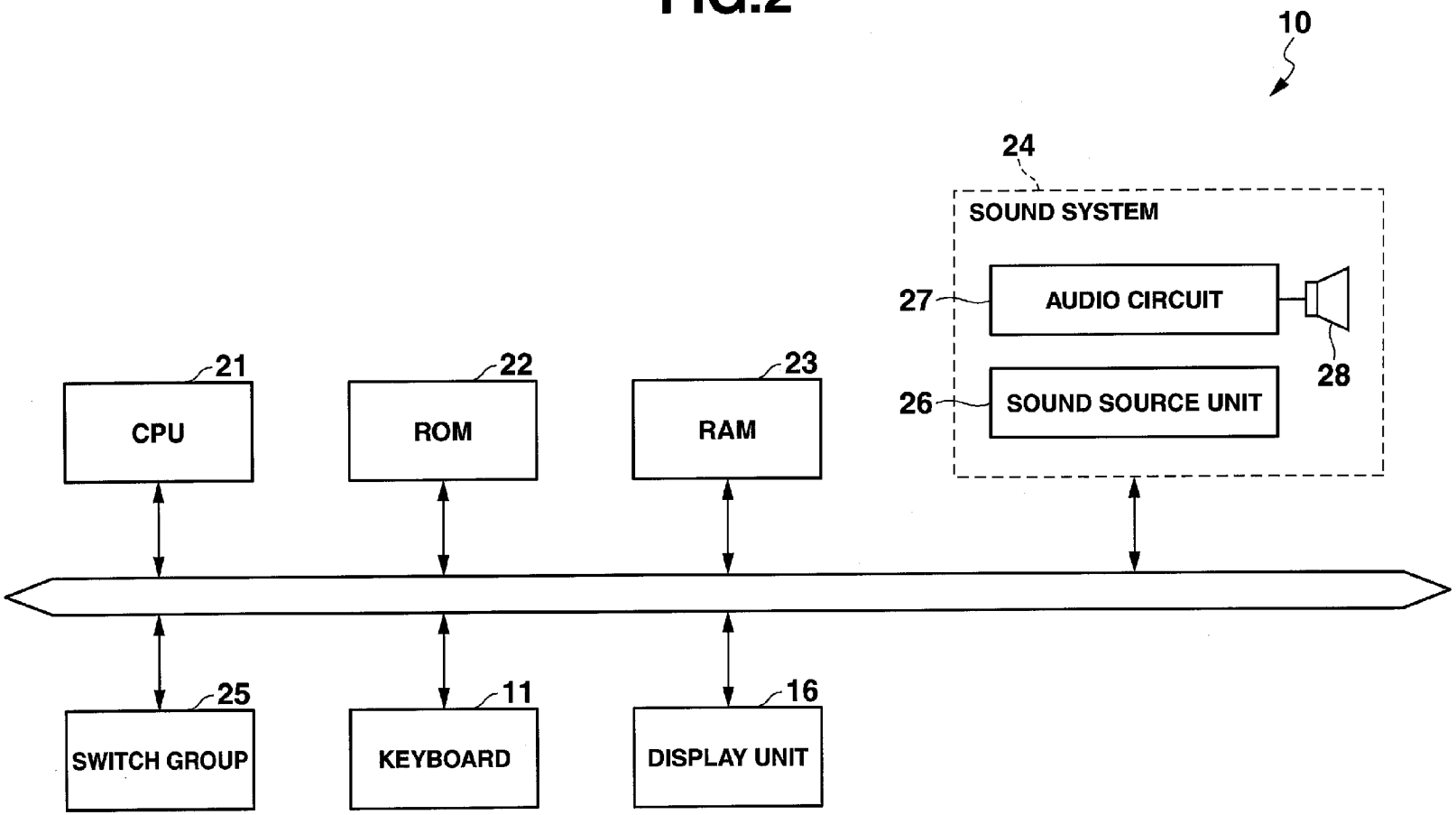
FIG. 2 is a block diagram showing a configuration of the electric keyboard musical instrument of FIG. 1.

FIG. 2 is a block diagram showing the configuration of the electric keyboard musical instrument 10 according to the present embodiment.

As shown in FIG. 2, the electric keyboard musical instrument 10 according to the present embodiment includes a CPU (Central Processing Unit) 21, ROM (Read Only Memory) 22, RAM (Random Access Memory) 23, a sound system 24, a switch group 25, the keyboard 11, and the display unit 16.

The CPU 21 executes various kinds of processing such as controlling the entire electric keyboard musical instrument 10, detecting key-pressing operations of keys on the keyboard 11 and operations of switches constituting the switch group 25 (for example, the acoustic piano select switch 12 of FIG. 1), controlling the sound system 24 in accordance with operations of keys and switches, and controlling a timing of sound generation according to the kind of tone selected.

The ROM 22 stores programs for various processing executed by the CPU 21 such as various processing corresponding to switch operations and key-pressing operations of any key on the keyboard, instructions to generate a musical sound in response to a key-pressing operation, controlling a timing in sound generation according to kinds of tone selected, and the like. Furthermore, the ROM 22 includes a waveform data area that stores waveforms to produce musical sounds from an acoustic piano, an electric piano, an electric organ, a harpsichord, etc. The RAM 23 stores programs read from the ROM 22 and the data created temporarily during processing.

The sound system 24 includes an audio source unit 26, an audio circuit 27, and a speaker 28. Upon receiving information relating to a key that is pressed from the CPU 21, the audio source unit 26 reads a predetermined waveform data from the waveform data area of the ROM 22 and generates and outputs musical sound data with a predetermined pitch. Furthermore, the sound source unit 26 reads waveform data of a tone of an acoustic piano or the like with a speed corresponding to a predefined pitch and outputs it as musical sound data. The audio circuit 27 executes D/A (Digital/Analog) conversion to the musical sound data and amplifies it. In this way, sound signals are outputted from the speaker 28.

Figure 3:
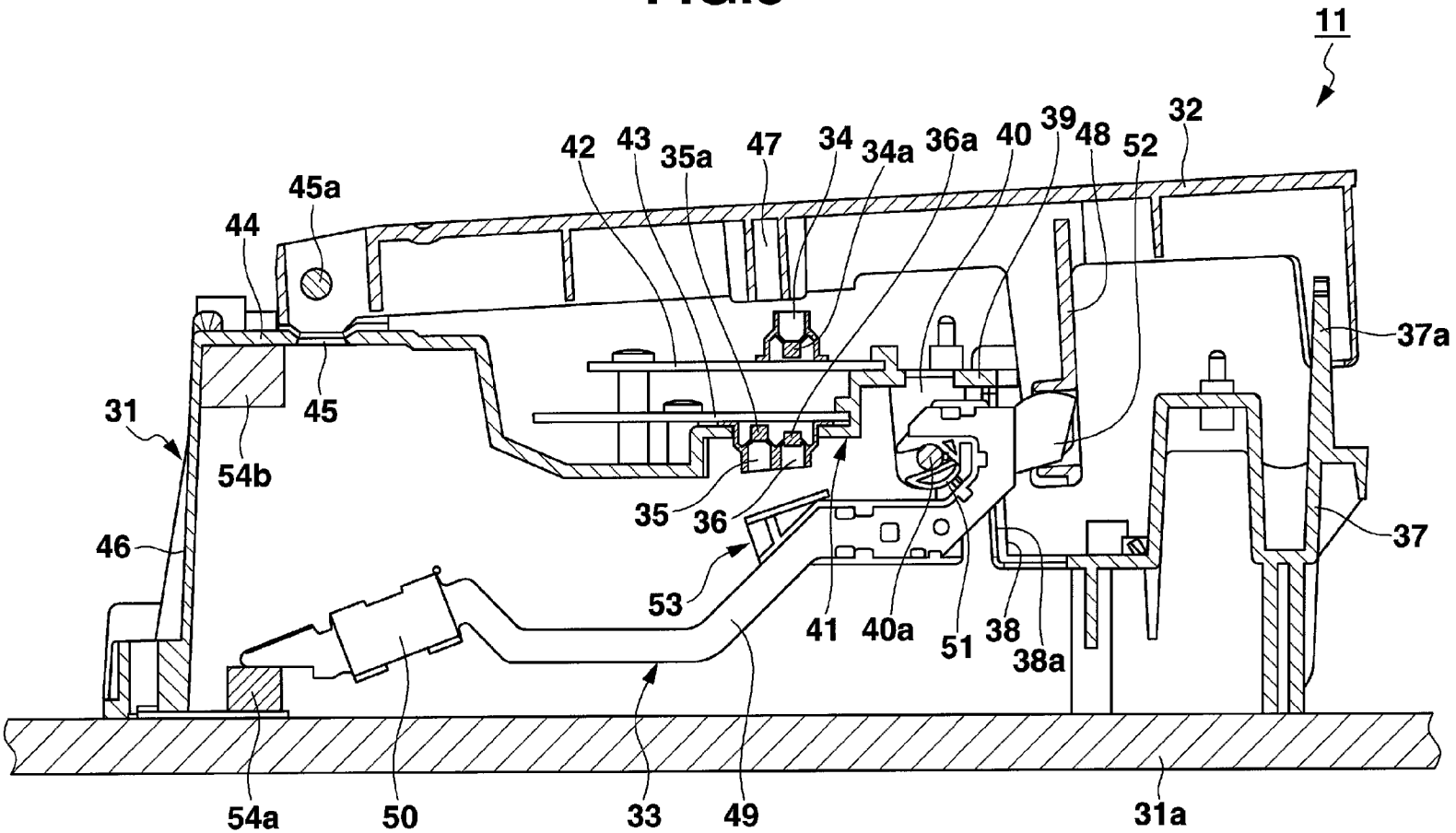
FIG. 3 is a vertical cross-sectional view showing a structure of the keyboard of the electric keyboard musical instrument of FIG. 2.

FIG. 3 is a vertical cross-sectional view illustrating a structure of the keyboard 11 according to the present embodiment. As illustrated in FIG. 3, the keyboard 11 includes: a keyboard chassis 31 made of synthetic resin; a plurality of keys 32 arranged so as to be pivotable in the vertical direction with respect to the keyboard chassis 31 on the keyboard chassis 31 (white keys and black keys; however, explanations are provided here using one white key in the present embodiment); a plurality of hammer members 33 arranged so as to apply action loading to each of the plurality of keys 32 (however, explanations are provided here using one hammer member in the present embodiment); a first switch substrate 42 having a first switch 34 that performs an ON operation by way of the plurality of hammer members 32; and a second switch substrate 43 having a second switch 35 and a third switch 36 that perform ON operations by way of the plurality of hammer members 33.

As illustrated in FIG. 3, the keyboard chassis 31 is disposed on a bottom plate 31*a* of a main body of the electric keyboard musical instrument 10 and a foreleg portion 37 is formed at a front edge part (a right edge part in FIG. 3) to protrude to an upper side from a bottom part. At the upper part of the foreleg portion 37, a key guide portion 37*a* is provided which prevents horizontal deflection of the key 32. As illustrated in FIG. 3, at the rear side (the left side in FIG. 3) of the foreleg portion 37, an upright portion 38 is formed to be located slightly lower than the key guide portion 37*a*.

The opening portion 38*a* for inserting a hammer into which the front part side of the hammer member 33 described later is inserted so as to move in the vertical direction is formed at the upright portion 38. At the upper part of the upright portion 38, a hammer placing portion 39 is formed in substantially a horizontal direction toward the rear part side (left side in FIG.

3). As illustrated in FIG. 3, at the lower part of this hammer placing portion 39, a hammer support portion 40 for supporting the hammer member 33 is provided such that it protrudes below. A support shaft 40*a* is provided which supports the hammer member 33 to be pivotable at this hammer support member 40.

Furthermore, as illustrated in FIG. 3, a substrate mounting portion 41 is formed at the rear side part of the hammer placing portion 39. As described later, the substrate mounting portion 41 is configured such that a first switch substrate 42 provided with the first switch 34 and a second switch substrate 43 provided with the second switch 35 and the third switch 36 are mounted so as to face to each other in a vertical direction.

Furthermore, at the rear part of the keyboard chassis 31, i.e. at the rear side part of the substrate mounting portion 41, a key placing portion 44 is formed to be slightly higher than the hammer placing unit 39. A key support portion 45 is formed at the upper face of this key placing portion 44. At the key support portion 45, a support shaft 45*a* is provided which supports the rear edge part of the key 32 so as to be pivotable in the vertical direction. Furthermore, as illustrated in FIG. 3, at the rear edge part of the key placing portion 44, a back leg portion 46 supporting the rear edge part of the keyboard chassis 31 hangs down.

On the other hand, as shown in FIG. 3, the key 32 is supported so as to be pivotable in the vertical direction by a support shaft 45*a* of the key support portion 45 of which a rear edge part (left edge part in FIG. 3) is disposed on the key placing portion 44 of the keyboard chassis 31. At an intermediate portion of the key 32, a switch pressing unit 47 that presses the first switch 34 of the first switch substrate 42 (described later) disposed at the substrate mounting portion 41 of the keyboard chassis 31 is formed to protrude to a lower side.

Furthermore, as illustrated in FIG. 3, at a portion of the key 32 located at a front side (left side in FIG. 3) of the switch pressing portion 47 of the key 32, a hammer guide portion 48 is formed to protrude toward a lower side of the key 32. This hammer guide portion 48 is configured so as to slidably insert a key abutting portion 52 located at the front edge part of the hammer member 33 (described later) so as to displace the key abutting portion 52 thus inserted in the vertical direction in response to the key-pressing operation to the key 32.

As illustrated in FIG. 3, the hammer member 33 includes: a hammer main body 49; a weight portion 50 provided at the rear part (left side part in FIG. 3) of this hammer main body 49; a pivot support unit 51 made of synthetic resin that is provided at the upper front side part (upper right side part in FIG. 3) so as to be the center of pivoting of the hammer main body 49; the key abutting portion 52 provided at the front edge part (right edge part) of the hammer main body 49; and a switch pressing portion 53 provided at an upper part at the intermediate portion of the hammer main body 49 for pressing the second switch 35 and the third switch 36 of the second switch substrate 43 as described later.

As illustrated in FIG. 3, this hammer member 33 allows the key abutting portion 52 of the hammer main body 49 to be inserted into the opening portion 38*a* of the upright portion 38 from the lower side of the keyboard chassis 31 so as to project toward the front side of the hammer placing portion 39. In this state, the hammer main body 49 is configured so as to pivot around the support shaft 40*a* of the hammer support portion 40 in the vertical direction by pivotably mounting the pivot support unit 51 of the hammer main body 49 to the support shaft 40*a* of the hammer support portion 40 provided at the hammer placing portion 39.

Furthermore, as illustrated in FIG. 3, this hammer member 33 is configured such that, when the pivot support portion 51 of the hammer main body 49 is pivotably mounted to the support shaft 40*a* of the hammer support portion 40, the key abutting portion 52 provided at the front edge part of the hammer main body 49 is slidably inserted into the hammer guide portion 48 of the key 32. And in this state, the key abutting portion 52 displaces in the vertical direction along with the hammer guide portion 48 in response to the key-pressing operation of the key 32, so that the hammer member 33 causes the hammer main body 49 to pivot in the vertical direction around the support shaft 40*a* of the hammer support portion 40.

In this way, as illustrated in FIG. 3, the hammer member 33 is configured such that, when the key 32 is in an initial state of the key 32 not being pressed, the hammer main body 49 pivots in the anti-clockwise direction around the support shaft 40*a* of the hammer support portion 40 due to the weight of the weight portion 50. And then the rear part of the hammer main body 49 abuts a lower limit stopper 54*a* made of felt or the like provided at a rear edge lower part of the keyboard chassis 31, so that the hammer member 33 is positionally restricted to a predetermined lower limit position.

Furthermore, the hammer member 33 is configured such that, when the key 32 is pressed from the upper side, the key abutting portion 52 of the hammer main body 49 is pressed down by the hammer guide portion 48 of the key 32 against the weight of the weight portion 50, and, along with this, an action load is applied to the key 32 by the hammer main body 49 pivoting in the clockwise direction around the support shaft 40*a* of the hammer support portion 40. And then the rear part of the hammer main body 49 abuts an upper limit stopper 54*b* made of felt or the like provided at a lower face of the key placing portion 44 of the keyboard chassis 31.

Incidentally, the first switch 34 is provided with the first contact 34*a* and is configured so as to contact the first switch substrate 42 in a contactable and separable manner. In this way, the first switch 34 is configured so as to output an ON signal by way of a switching operation by the first contact 34*a* contacting the first switch substrate 42 when the key 32 is pressed.

Furthermore, this first switch 34 is configured so as to output an OFF signal when the first contact 34*a* is released from the first switch substrate 42 upon returning to an initial position after the key 32 is pressed.

The second switch 35 and the third switch 36 include the second contact 35*a* and the third contact 36*a*, respectively, and the second contact 35*a* and the third contact 36*a* are configured so as to sequentially contact the second switch substrate 43 in a contactable and separable manner. In addition, it should be noted that the second contact 35*a* contacts prior to the third contact 36*a* and the third contact 36*a* being released prior to the second contact 35*a*.

In this way, the second switch 35 and the third switch 36 are configured so as to output an ON signal sequentially by way of a switching operation due to the second contact 35*a* and the third contact 36*a* sequentially contacting the second switch substrate 43 at different timing upon being pressed from the lower side by the switch pressing portion 53 of the hammer member 33.

Furthermore, this second switch 35 and third switch 36 are configured so as to output an OFF signal sequentially due to the second contact 35*a* and the third contact 36*a* separating from the second switch substrate 43 upon returning to an initial position after the key 32 is pressed.

Figure 4:
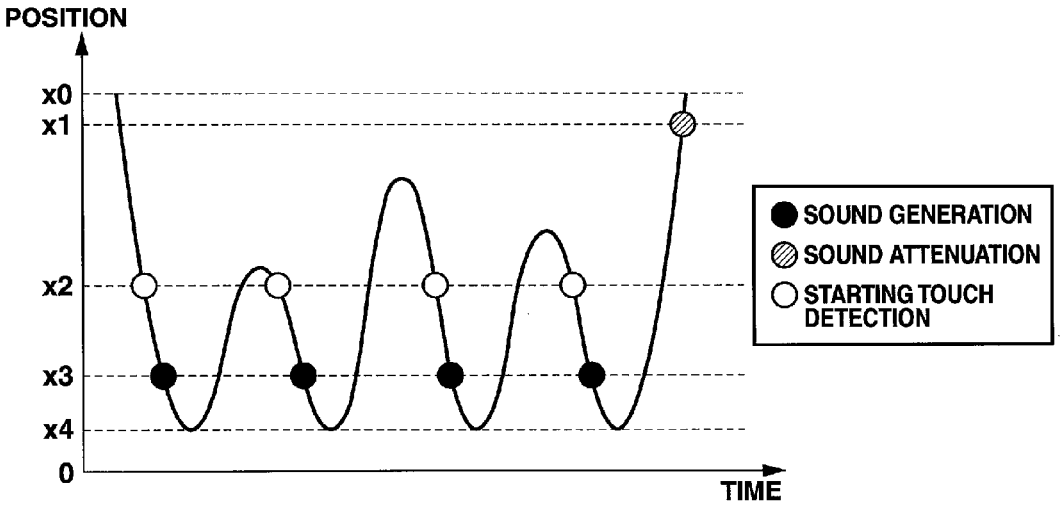
FIG. 4 is a view illustrating a relationship between a rate of key-pressing of a key and timing in sound generation at the keyboard of FIG. 3.

FIG. 4 is a view illustrating a relationship between a rate of key-pressing of the key 32 and timing of sound generation according to the present embodiment. The horizontal axis represents time and the vertical axis represents a position of the key 32. The position of the key 32 represents a rate of key-pressing of the key 32. The position x0 represents that the rate of key-pressing is 0. The position x4 represents a maximum value of a rate of key-pressing, i.e. a maximum value of a rate for which a key can be physically pressed down.

When the key 32 starts to be pressed and is pressed down to the position x1, the first contact 34*a* contacts the first switch substrate 42 so that the first switch 34 outputs an ON signal. Next, when the key 32 is pressed to the position x2, the second contact 35*a* contacts the second switch substrate 43 so that the second switch 35 outputs an ON signal. At this moment, touch detection is started. Furthermore, when the key 32 is pressed to the position x3, the third contact 36*a* contacts the second switch substrate 43 so the third switch 36 outputs an ON signal. At this moment, sound generation processing is executed.

Then, when the key 32 is pressed to the position x4 and the key starts to separate and the key 32 returns to the position x3, the third contact 36*a* separates from the second switch substrate 43 so that the third switch 36 outputs an OFF signal. Next, when the key 32 returns to the position x2, the second contact 35*a* is released from the second switch substrate 43 so that the second switch 35 outputs an OFF signal. Furthermore, when the key 32 returns to the position x1, the first contact 34*a* separates from the first switch substrate 42 so that the first switch 34 outputs an OFF signal. At this moment, sound attenuation processing is executed.

Therefore, as illustrated in FIG. 4, after the key 32 returns to the position x2, in a case in which the key 32 is pressed again before the key 32 returns to the position x1, and then the key 32 is pressed down to the positions x2 and x3, the sound attenuation processing is not executed, but rather the sound generation processing is executed again. It is thereby possible to generate musical sound with pitch corresponding to the key 32 continuously at short time intervals.

In the following, processing executed in the electric keyboard musical instrument 10 according to the present embodiment is described in detail.

Figure 5:
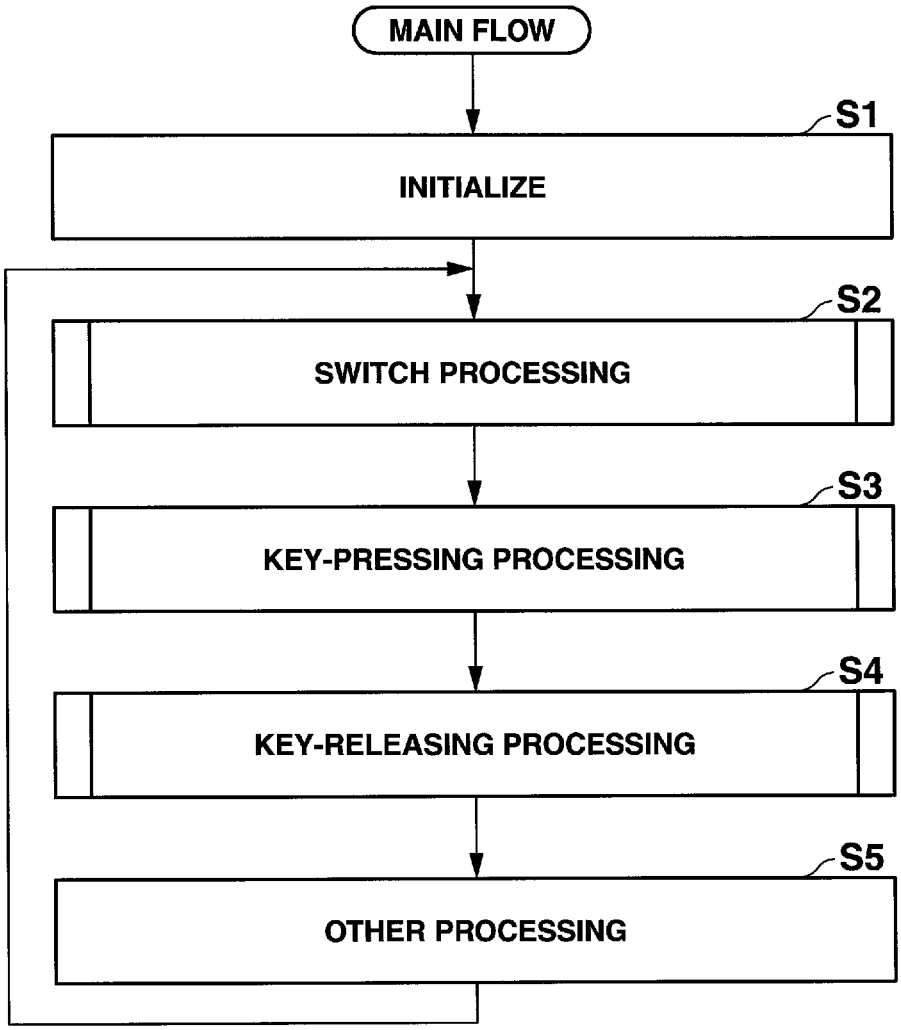
FIG. 5 is a flowchart showing a main flow executed in the electric keyboard musical instrument of FIG. 1.

FIG. 5 is a flowchart showing a main flow executed in the electric keyboard musical instrument 10 according to the present embodiment. It should be noted that, although not shown, timer increment processing is executed which increments a counter value of an interrupt counter at a predetermined time interval during the execution of the main flow.

As shown in FIG. 5, when the power supply of the electric keyboard musical instrument 10 is activated, in Step S1, the CPU 21 of the electric keyboard musical instrument 10 (hereinafter, simply referred to as "CPU 21") executes initialization processing including the clearing of data in the RAM 23 and an image on the display unit 16. In Step S2, the CPU 21 detects operations on switches constituting the switch group 25 and executes switch processing to execute processing in accordance with the operations thus detected. The switch processing is described later with reference to FIG. 6.

In Step S3, the CPU 21 executes key-pressing processing. Here, the key-pressing processing refers to processing that executes control of sound generation according to the kind of tone. The key-pressing processing is described with reference to FIGS. 7 and 8. In Step S4, the CPU 21 executes key-releasing processing. Here, the key-releasing processing refers to processing to execute control of sound attenuation according to the kind of tone. The key-releasing processing is described later with reference to FIGS. 9 and 10.

In Step S5, the CPU 21 executes other processing including various processing such as the display of an image on the display unit 16, and activation and deactivation of LEDs (not illustrated), and returns the processing to Step S2. Then, the CPU 21 repeats the processing of Steps S2 to S5.

Next, with reference to each of the flowcharts of FIGS. 6 to 10, the details of switch processing of Step S2, the key-pressing processing of Step S3, and the key-releasing processing of Step S4 in the main flow of FIG. 5 are each described individually in this order.

Figure 6:
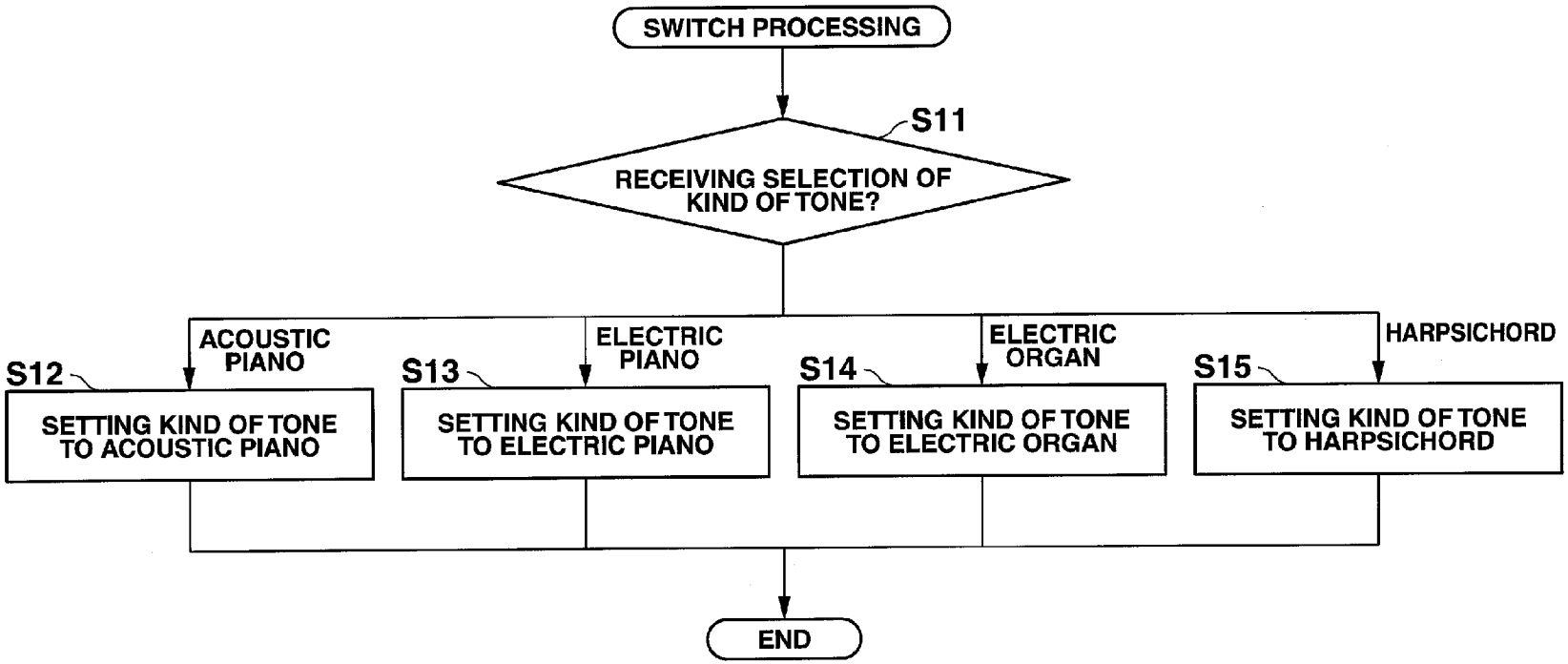
FIG. 6 is a flowchart illustrating the details of switch processing in Step S2 of the main flow of FIG. 5.

FIG. 6 is a flowchart illustrating the details of the switch processing in Step S2 of the main flow of FIG. 5.

In Step S11, the CPU 21 receives a selection of a kind of tone. For example, when any one among the acoustic piano select switch 12, the electric piano select switch 13, the electric organ select switch 14, and the harpsichord select switch 15 is pressed, the CPU 21 receives a selection of a kind of the tone by detecting which switch was pressed and specifying a kind of the tone.

In a case in which the kind of tone thus specified is an acoustic piano, the CPU 21 sets the kind of tone as an acoustic piano in Step S12.

Furthermore, in a case in which the kind of tone thus specified is an electric piano, the CPU 21 sets the kind of tone as an electric piano in Step S13.

Furthermore, in a case in which the kind of tone thus specified is an electric organ, the CPU 21 sets the kind of tone as an electric organ in Step S14.

Furthermore, in a case in which the kind of tone thus specified is a harpsichord, the CPU 21 sets the kind of tone as a harpsichord in Step S15.

When the processing of Steps S12, S13, S14 or S15 ends, the CPU 21 further stores information indicating the kind of tone set in a predetermined area of the RAM 23. Although not illustrated, the operations on various switches that start and end the demonstration musical performances, designate rhythm patterns, and the like are detected. In this way, the switch processing ends. In other words, the processing of Step S2 of FIG. 5 ends, and the sequences of the processing illustrated in FIGS. 7 and 8 are executed as the key-pressing processing of Step S3.

Figure 7:
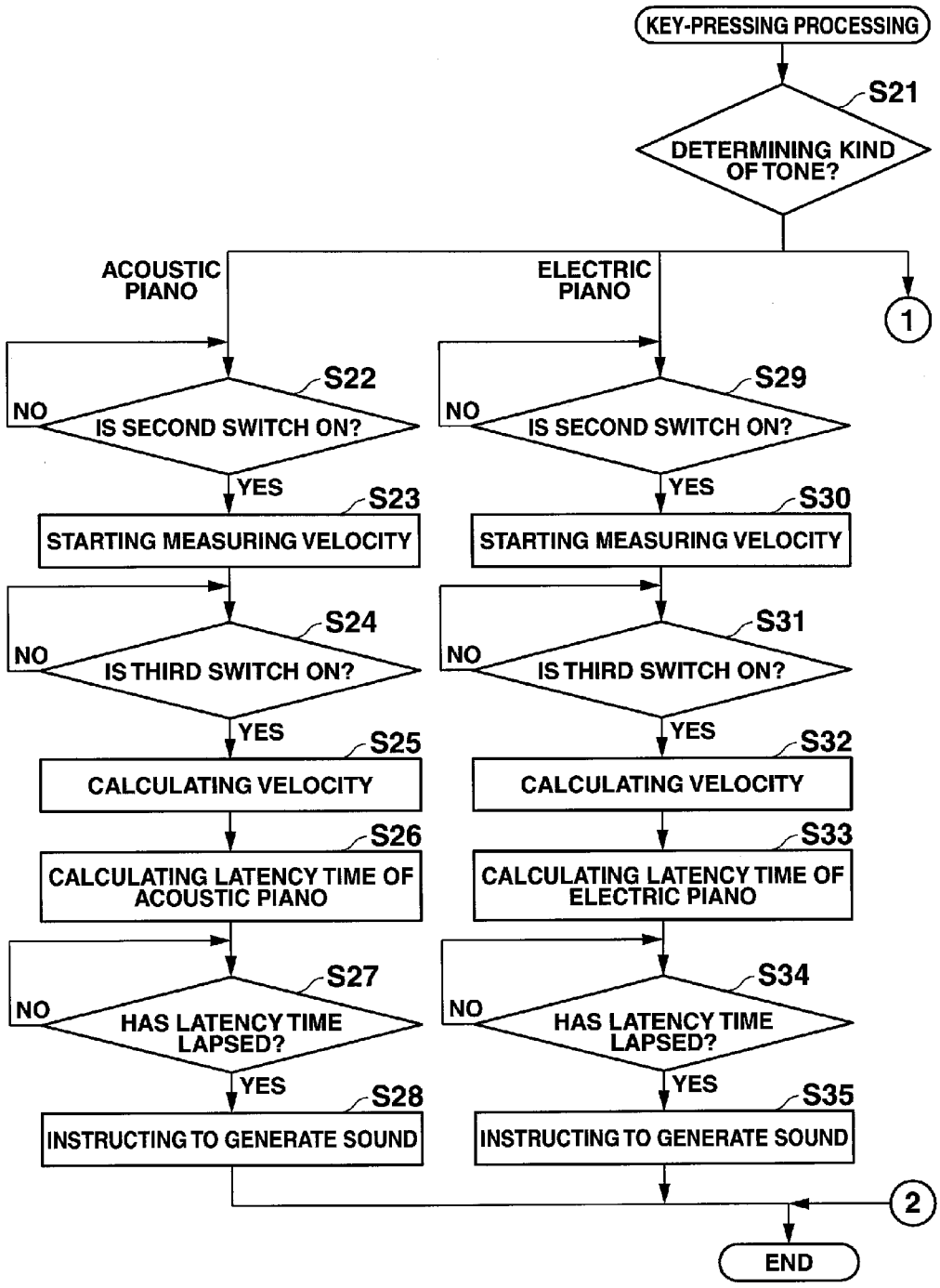
FIG. 7 is a flowchart illustrating the key-pressing processing of Step S3 in the main flow of FIG. 5.
Figure 8:
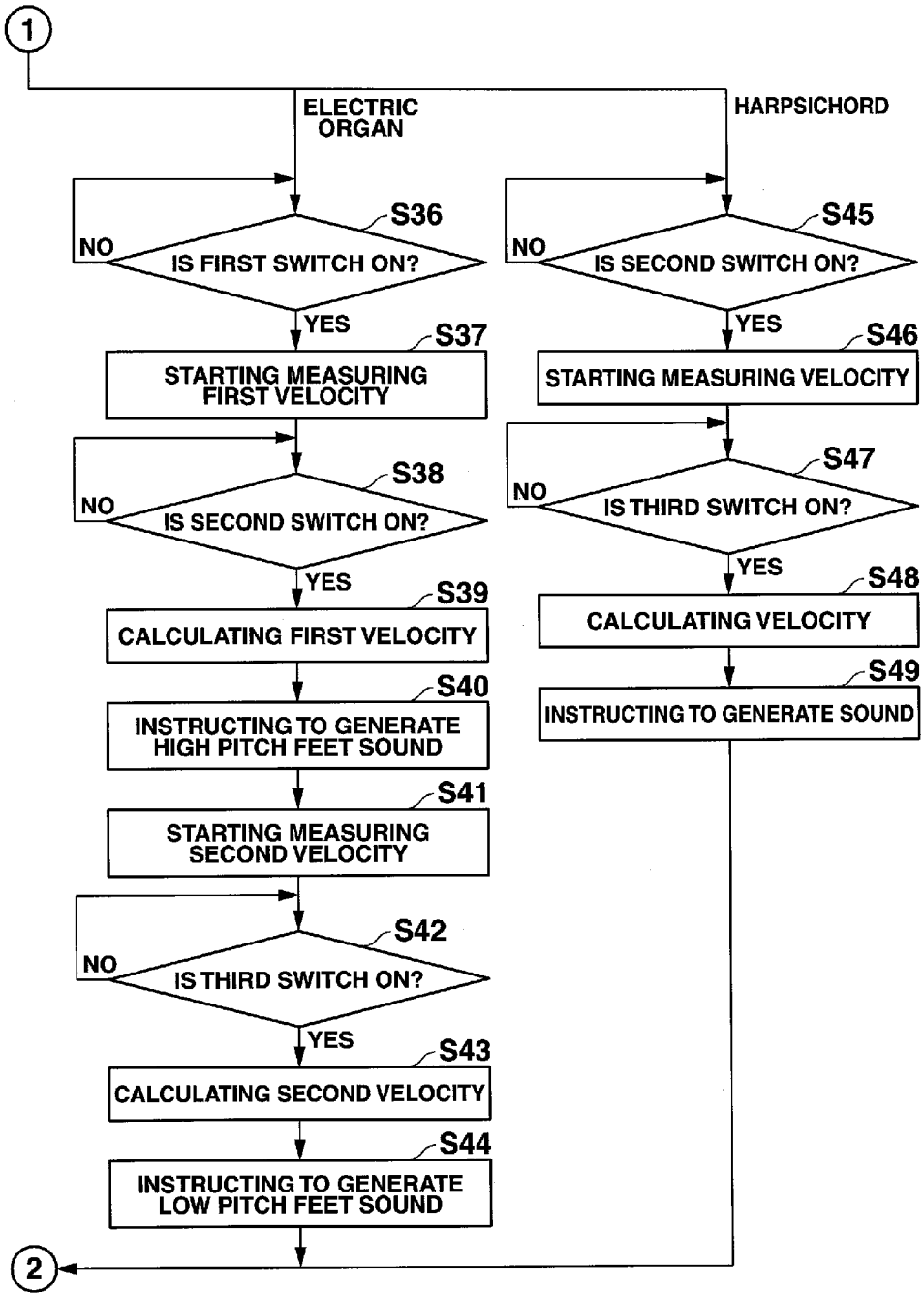
FIG. 8 is a flowchart illustrating the key-pressing processing of Step S3 in the main flow of FIG. 5.

FIGS. 7 and 8 are flowcharts illustrating details of the key-pressing processing of Step S3 in the main flow of FIG. 5.

In Step S21, the CPU 21 determines the kind of tone. More specifically, the CPU 21 refers to information indicating a kind of tone stored in a predetermined area of the RAM 23 so as to determine the kind of tone.

In a case of a determination result in which the kind of tone is an acoustic piano, the CPU 21 executes the sequence of processing of Steps S22 to S28 (hereinafter, referred to as processing of "an acoustic piano"). In a case of a determination result in which the kind of tone is an electric piano, the CPU 21 executes the sequence of processing of Steps S29 to S35 (hereinafter, referred to as processing of "an electric piano"). In a case of a determination result in which the kind of tone is an electric organ, the CPU 21 executes the sequence of processing of Steps S36 to S44 (hereinafter, referred to as processing of "an acoustic organ"). In a case of a determination result in which the kind of tone is a harpsichord, the CPU 21 executes the sequence of processing of Steps S45 to S49 (hereinafter, referred to as processing of "a harpsichord").

In the following, the respective processing of an acoustic piano, an electric piano, an electric organ, and a harpsichord is described individually in this order.

Processing of Acoustic Piano

In Step S22, the CPU 21 determines whether the second switch 35 is ON. More specifically, the CPU 21 determines whether the ON signal from the second switch 35 has been detected, the signal of which is outputted when the key 32 is pressed to the position x2 (refer to FIG. 4) so that the second contact 35*a* comes into contact with the second switch substrate 43. In a case in which this determination is Yes, the CPU 21 advances the processing to Step S23, and in a case in which this determination is No, the CPU 21 returns the processing to Step S22.

Therefore, in Step S22, until the second switch 35 is determined to be ON, the CPU 21 repeatedly executes the determination processing of Step S22. Then, when the second switch 35 is determined to be ON, the CPU 21 advances the processing to Step S23.

In Step S23, the CPU 21 starts velocity measurement. More specifically, the CPU 21 starts measuring a time necessary for calculating velocity in Step S25 described later. It should be noted that the time when measurement starts in Step S23 refers to an elapsed time during which the key 32 moves from the position x2 to the position x3.

In Step S24, the CPU 21 determines whether the third switch 36 is ON. More specifically, the CPU 21 determines whether the ON signal from the third switch 36 has been detected, the signal of which is outputted when the key 32 is pressed to the position x3 (refer to FIG. 4) so that the third contact 36*a* comes into contact with the second switch substrate 43. In a case in which this determination is Yes, the CPU 21 advances the processing to Step S25, and in a case in which this determination is No, the CPU 21 returns the processing to Step S24.

Therefore, in Step S24, until the third switch 36 is determined to be ON, the CPU 21 repeatedly executes the determination processing of Step S24. Then, when the third switch 36 is determined to be ON, the CPU 21 advances the processing to Step S25.

In Step S25, the CPU 21 calculates velocity. Velocity refers to the strength of a key-pressing of key 32 which indicates the volume of sound generation and can be calculated based on the speed of the key 32. Therefore, the CPU 21 ends "measuring a time" started in the processing of Step S23, and calculates the speed of the key 32 as velocity, based on the distance between the position x2 and the position x3 of the key 32 and the measured time.

In Step S26, the CPU 21 calculates a latency time of an acoustic piano. Latency time of an acoustic piano refers to a time from when the CPU 21 detects that the third switch 36 becomes ON until the CPU 21 transmits a sound generation instruction signal to the sound source unit 26 in a case in which the kind of tone is an acoustic piano. In an actual acoustic piano, since there is a time lag from the time when a key is pressed down to its end and a hammer thereof operates until the time when the hammer hits a string and a sound is generated, it is configured so that this time lag can be applied to the electric keyboard musical instrument 10 of the present embodiment. The same applies to an electric piano described later as well. The delay time of an acoustic piano is calculated by multiplying a coefficient stored in a coefficient table shown in FIG. 12 by a delay time of an acoustic piano stored in a delay time table shown in FIG. 11.

Here, the delay time table is described.

FIG. 11 illustrates an example of the structure of the delay time table.

According to this delay time table, a delay time corresponding to each key number is set to be smaller with higher pitch, i.e. with a higher key number. This is because the hammer is smaller in a high-tone range than in a low-tone range, and thus the delay time after key-pressing becomes small. Furthermore, a delay time of an acoustic piano is set to be longer than a delay time of an electric piano. This is because the range of motion of a hammer of an acoustic piano is wider than that of an electric piano, and thus the delay time after key-pressing becomes longer.

Next, a coefficient table is described.

FIG. 12 illustrates an example of the structure of a coefficient table.

According to this coefficient table, a coefficient corresponding to each velocity range is set to be greater as the velocity range becomes greater. Here, a velocity range is a concept that corresponds to a range of velocity values. For example, the velocity calculated by the processing of Step S25 in FIG. 7 belongs to any one from among the 127 steps of velocity ranges in the coefficient table, and if the velocity thus calculated is a greater value, the value belongs to a velocity range corresponding to a greater value. The reason in that a coefficient corresponding to each velocity range is greater as the velocity range is greater in the coefficient table is that an operation speed of a hammer is faster when a key is pressed strongly; therefore, the time lag from the time when a key is pressed down to its end until the time when the hammer hits a string and a sound is generated becomes shorter and, since an operation speed of a hammer is slower when a key is pressed softly, the time lag becomes longer.

Therefore, more specifically, the following processing is executed as the processing of Step S26 in FIG. 7. In other words, the CPU 21 calculates a latency time of an acoustic piano by multiplying a delay time of an acoustic piano corresponding to a key number of the key 32 by a coefficient corresponding to a velocity range belonging to a velocity calculated in the processing of Step S25.

In Step S27, the CPU 21 determines whether a latency time of an acoustic piano lapsed. In a case in which the latency time of an acoustic piano has not elapsed, the CPU 21 determines as NO in Step 27 and returns the processing to Step S27. In other words, the processing of an acoustic piano enters a standby state by repeatedly executing the determination processing of Step S27 during a time until the latency time of an acoustic piano elapsed.

Then, in a case in which the latency time of an acoustic piano has elapsed, the CPU 21 determines as YES in Step S27 and advances the processing to Step S27.

In Step S28, the CPU 21 executes an instruction to generate a sound. More specifically, the CPU 21 supplies a pitch of a musical sound to be generated and a Note-on-Event indicating a velocity to the sound source unit 26. The sound source unit 26 reads waveform data of the ROM 22 based on a pitch, a velocity, and a kind of tone determined in Step S21 so as to generate musical sound data. In this way, a musical sound is generated from the speaker 28. When the processing of Step S28 ends, the processing of key-pressing ends.

Processing of Electric Piano

Next, the processing of an electric piano is described.

In a case in which a kind of tone is determined to be an electric piano in the processing of Step S21, the processing of the following Steps S29 to S35 is executed as the processing of an electric piano.

In Step S29, the CPU 21 determines whether the second switch 35 is ON. The specific processing is similar to that of Step S22. Therefore, the processing of an electric piano enters a standby state by the determination processing of Step S29 being repeatedly executed during a time until the ON signal from the second switch 35 is outputted. Then, when the ON signal from the second switch 35 is outputted, in Step S29, it is determined that the second switch 35 is ON, and the processing advances to Step S30.

In Step S30, the CPU 21 starts measuring velocity. More specifically, the CPU 21 starts measuring a time necessary for calculating velocity in Step S32 described later. It should be noted that the time when a measurement starts in Step S30 refers to an elapsed time during which the key 32 moves from the position x2 to the position x3.

In Step S31, the CPU 21 determines whether the third switch 36 is ON. The specific processing is similar to that in Step S24. Therefore, the processing of an electric piano enters a standby state by the determination processing of Step S31 being repeatedly executed during a time until the ON signal from the third switch 36 is outputted. Then, when the ON signal from the third switch 36 is outputted, in Step S31, it is determined that the third switch 36 is ON, and the processing advances to Step S32.

In Step S32, the CPU 21 calculates velocity. The specific processing is similar to that of Step S25.

In Step S33, the CPU 21 calculates a latency time of an electric piano. Latency time of an electric piano refers to a time from when the CPU 21 detects that the third switch becomes ON until the CPU 21 transmits a sound generation instruction signal to the sound source unit 26 in a case in which the kind of tone is an electric piano. In an actual electric piano, since there is a time lag from the time when a key is pressed down to its end and a hammer thereof operates until the time when the hammer hits a string and a sound is generated, it is configured so that this time lag can be applied to the electric keyboard musical instrument 10 of the present embodiment. The same applies to the abovementioned acoustic piano. Similarly to the abovementioned method in Step S26, the delay time of an electric piano is calculated by multiplying a coefficient stored in a coefficient table shown in FIG. 12 by a delay time of an electric piano stored in a delay time table shown in FIG. 11.

In Step S34, the CPU 21 determines whether a latency time of an electric piano elapsed. In a case in which the latency time of an electric piano does not lapsed, the CPU 21 determines as NO in Step 34 and returns the processing to Step S34. In other words, the processing of an electric piano enters a standby state by repeatedly executing the determination processing of Step S34 during a time until the latency time of an electric piano has elapsed.

Then, in a case in which the latency time of an electric piano elapsed, the CPU 21 determines as YES in Step S34 and advances the processing to Step S35.

In Step S35, the CPU 21 executes an instruction to generate a sound. The specific processing is similar to that of Step S28. When the processing of Step S35 ends, the CPU 21 ends the processing of key-pressing.

Processing of Electric Organ

Next, the processing of an electric organ is described.

In a case in which the kind of tone is determined to be an electric organ in the processing of Step S21, the processing of the following Steps S36 to S44 is executed as the processing of an electric organ.

With reference to FIG. 8, in Step S36, the CPU 21 determines whether the first switch 34 is ON. More specifically, the CPU 21 determines whether the ON signal from the first switch 34 has been detected, the signal of which is outputted when the key 32 is pressed to the position x1 (refer to FIG. 4) so that the first contact 34*a* comes into contact with the first switch substrate 42. In a case in which this determination is Yes, the CPU 21 advances the processing to Step S37, and in a case in which this determination is No, the CPU 21 returns the processing to Step S36.

Therefore, in Step S36, until the first switch 34 is determined to be ON, the CPU 21 repeatedly executes the determination processing of Step S36. Then, when the first switch 34 is determined to be ON, the CPU 21 advances the processing to Step S37.

In Step S37, the CPU 21 starts measuring the first velocity. More specifically, the CPU 21 starts measuring a time necessary for calculating the fist velocity in Step S39 described later. It should be noted that the time when measurement starts in Step S37 refers to an elapsed time during which the key 32 moves from the position x1 to the position x2.

In Step S38, the CPU 21 determines whether the second switch is ON. The specific processing is similar to that of Step S22. Therefore, the processing of an electric organ enters a standby state by the determination processing of Step S38 being repeatedly executed during a time until the ON signal from the second switch 35 is outputted. Then, when the ON signal from the second switch 35 is outputted, in Step S38, it is determined that the second switch 35 is ON, and the processing advances to Step S39.

In Step S39, the CPU 21 calculates the first velocity. More specifically, the CPU 21 ends "measuring a time" started in the processing of Step S37 and calculates the first velocity, which is a first speed of the key 32 based on the distance between the position x1 and the position x2 of the key 32.

In Step S40, the CPU 21 executes an instruction to generate a high pitch feet sound. The high pitch feet sound refers to high pitch harmonics among the 9 harmonics to be generated simultaneously, for example, from the fifth harmonic to the ninth harmonic. More specifically, the CPU 21 supplies a pitch of a musical sound to be generated and a Note-on-Event indicating a velocity to the sound source unit 26. The sound source unit 26 reads waveform data of the ROM 22 based on a pitch, a velocity, and the kind of tone determined in Step S21 so as to generate musical sound data. In this way, a musical sound is generated from the speaker 28. In an actual organ, since the high pitch feet sound starts to be generated at a smaller rate of key-pressing as compared to a piano, in the present embodiment, it is configured so that an actual organ's sound generation mechanism can be applied to the electric keyboard musical instrument 10.

In the present embodiment, an instruction for sound generation is executed in Step S40 immediately after measuring the first velocity. Therefore, it may be configured so that a delay time of an electric organ is provided to the delay time table of FIG. 11 and each delay time corresponding to each key number is set to be zero (refer to FIG. 13), and, in Step S40, the CPU 21 refers to the delay time table and acquires a delay time of an electric organ "0".

In Step S41, the CPU 21 starts measuring the second velocity. More specifically, the CPU 21 starts measuring a time necessary for calculating the fist velocity in Step S43 described later. It should be noted that the time when measurement starts in Step S41 refers to an elapsed time during which the key 32 moves from the position x2 to the position x3.

In Step S42, the CPU 21 determines whether the third switch is ON. The specific processing is similar to that of Step S24. Therefore, the processing of an electric organ enters a standby state by the determination processing of Step S42 being repeatedly executed during a time until the ON signal from the third switch 36 is outputted. Then, when the ON signal from the third switch 36 is outputted, in Step S42, it is determined that the third switch 36 is ON, and the processing advances to Step S43.

In Step S43, the CPU 21 calculates the second velocity. More specifically, the CPU 21 ends "measuring a time" started in the processing of Step S41 and calculates the second velocity, which is a second speed of the key 32 based on the distance between the position x2 and the position x3 of the key 32.

In Step S44, the CPU 21 executes an instruction to generate a low pitch feet sound. The low pitch feet sound refers to low pitch harmonics among 9 harmonics to be generated simultaneously, for example, from the first harmonic to the fourth harmonic. More specifically, the CPU 21 supplies a pitch of a musical sound to be generated and a Note-on-Event indicating a velocity to the sound source unit 26. The sound source unit 26 reads waveform data of the ROM 22 based on a pitch, a velocity, and the kind of tone determined in Step S21 so as to generate musical sound data. In this way, a musical sound is generated from the speaker 28. In an actual organ, since the low pitch feet sound starts to be generated with greater rate of key-pressing similarly to a piano, in the present embodiment, it is configured so that an actual organ's sound generation mechanism can be applied to the electric keyboard musical instrument 10. When the processing of Step S44 ends, the CPU 21 ends the processing of key-pressing.

In the present embodiment, an instruction of sound generation is executed in Step S44 immediately after measuring the second velocity. Therefore, it may be configured so that a delay time of an electric organ is provided to the delay time table of FIG. 11 and each delay time corresponding to each key number is set to be zero (refer to FIG. 13), and, in Step S44, the CPU 21 refers to the delay time table and acquires a delay time of an electric organ "0".

Processing of Harpsichord

Next, the processing of a harpsichord is described.

In a case in which the kind of tone is determined to be a harpsichord in the processing of Step S21, the processing of the following Steps S45 to S49 is executed as the processing of a harpsichord.

In Step S45, the CPU 21 determines whether the second switch is ON. The specific processing is similar to that of Step S22. Therefore, the processing of a harpsichord enters a standby state by the determination processing of Step S45 being repeatedly executed during a time until the ON signal from the second switch 35 is outputted. Then, when the ON signal from the second switch 35 is outputted, in Step S45, it is determined that the second switch 35 is ON, and the processing advances to Step S46.

In Step S46, the CPU 21 calculates the first velocity. More specifically, the CPU 21 starts measuring a time necessary for calculating velocity in Step S48 described later. It should be noted that the time when measurement starts in Step S46 refers to an elapsed time during which the key 32 moves from the position x2 to the position x3.

In Step S47, the CPU 21 determines whether the third switch is ON. The specific processing is similar to that of Step S24. Therefore, the processing of an electric organ enters a standby condition by the determination processing of Step S47 being repeatedly executed during a time until the ON signal from the third switch 36 is outputted. Then, when the ON signal from the third switch 36 is outputted, in Step S47, it is determined that the third switch 36 is ON, and the processing advances to Step S48.

In Step S48, the CPU 21 calculates velocity. The specific processing is similar to that of Step S25.

In Step S49, the CPU 21 executes an instruction to generate a sound. The specific processing is similar to that of Step S28. When the processing of Step S49 ends, the CPU 21 ends the processing of key-pressing.

In the present embodiment, an instruction of sound generation is executed in Step S49 immediately after measuring the velocity. Therefore, it may be configured so that a delay time of a harpsichord is provided to the delay time table of FIG. 11 and each delay time corresponding to each key number is set to be zero (refer to FIG. 13), and, in Step S49, the CPU 21 refers to the delay time table and acquires a delay time of a harpsichord "0".

Figure 9:
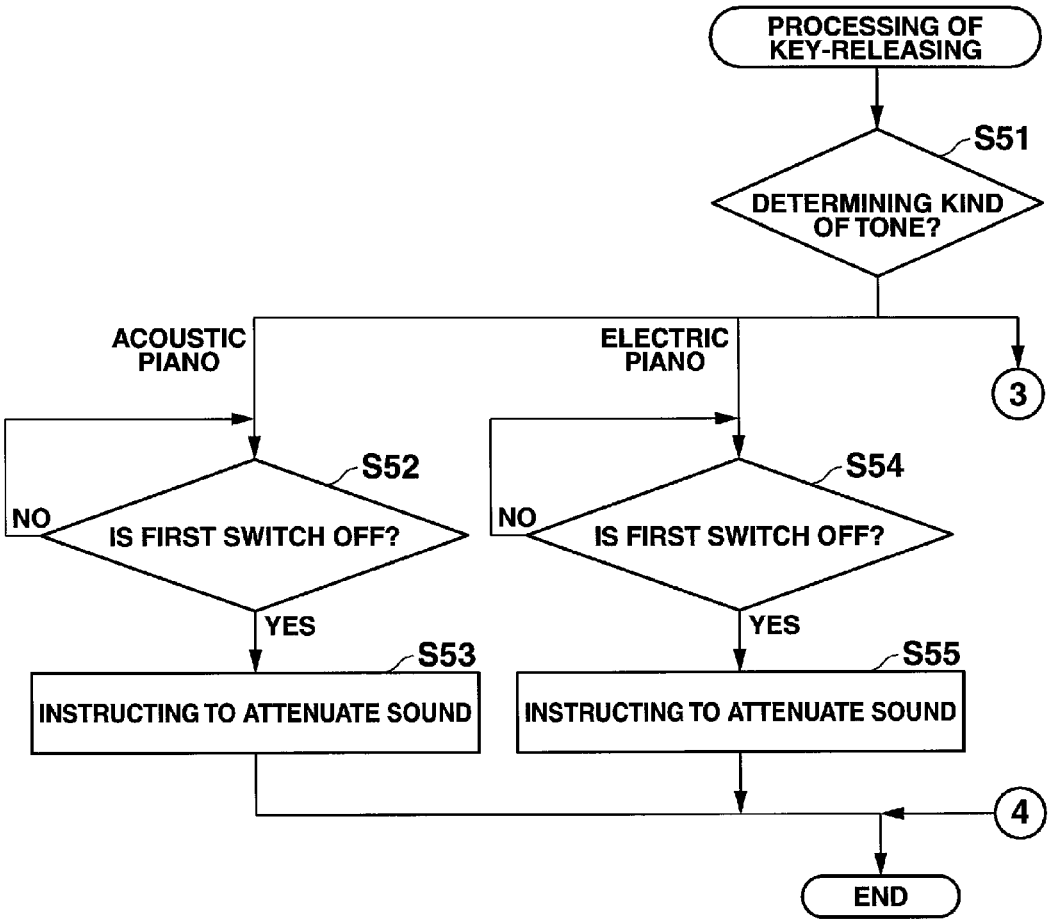
FIG. 9 is a flowchart illustrating the processing of key-releasing of Step S4 of the main flow of FIG. 5.
Figure 10:
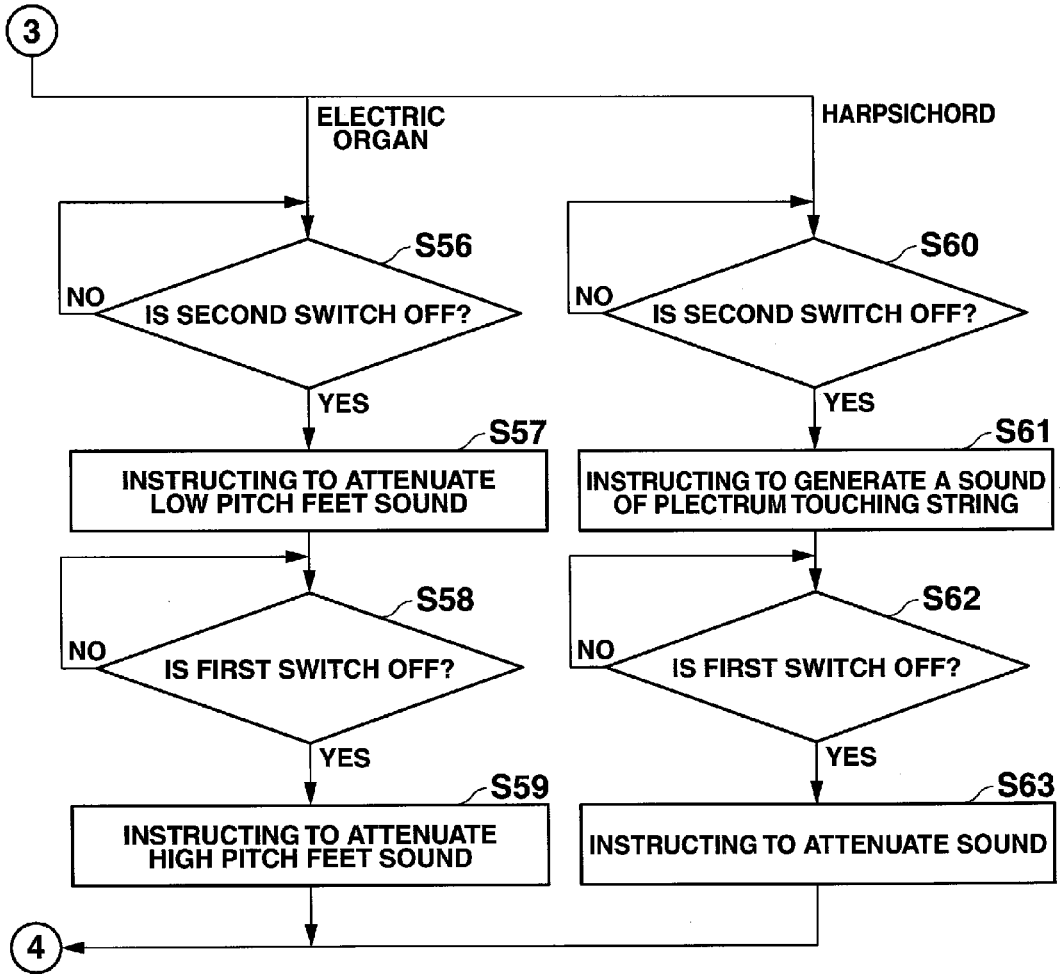
FIG. 10 is a flowchart illustrating the processing of key-releasing of Step S4 of the main flow of FIG. 5.

FIGS. 9 and 10 are flowcharts illustrating processing of key-releasing according to the present embodiment. In Step S51, the CPU 21 determines the kind of tone. More specifically, the CPU 21 refers to information indicating a kind of tone stored in a predetermined area of the RAM 23 so as to determine the kind of tone. With this determination, in a case of a determination result in which the kind of tone is an acoustic piano, the CPU 21 executes the processing of Steps S52 and S53 (hereinafter, referred to as processing of "an acoustic piano"). In a case of a determination result in which the kind of tone is an electric piano, the CPU 21 executes the processing of Steps S54 and S55 (hereinafter, referred to as processing of "an electric piano"). In a case of a determination result in which the kind of tone is an electric organ, the CPU 21 executes processing of Steps S56 to S59 (hereinafter, referred to as processing of "an electric organ"). Furthermore, in a case of a determination result in which the kind of tone is a harpsichord, the CPU 21 executes the processing of Steps S60 to S63 (hereinafter, referred to as processing of "a harpsichord").

In the following, each processing of an acoustic piano, an electric piano, an electric organ, and a harpsichord is described individually in this order.

Processing of Acoustic Piano

In Step S52, the CPU 21 determines whether the first switch 34 is OFF. More specifically, the CPU 21 determines whether an OFF signal from the first switch 34 has been detected, the signal of which is outputted when the key 32 is pressed and returns to the position x1 (refer to FIG. 4) so that the first contact 34*a* is separated from the first switch substrate 42. In a case in which this determination is Yes, the CPU 21 advances the processing to Step S53, and in a case in which this determination is No, the CPU 21 returns the processing to Step S52.

Therefore, in Step S52, until the first switch 34 is determined to be OFF, the CPU 21 repeatedly executes the determination processing of Step S52. Then, when the first switch 34 is determined to be OFF, the CPU 21 advances the processing to Step S53.

In Step S53, the CPU 21 executes a sound attenuation instruction. More specifically, the CPU 21 supplies a Note-off-Event indicating a pitch of a musical sound to be attenuated to the sound source unit 26 and instructs to attenuate a musical sound of the pitch indicated by the Note-off-Event. When the processing of Step S53 ends, the processing of key-releasing ends.

Processing of Electric Piano

Next, the processing of an electric piano is described.

In a case in which the kind of tone is determined to be an electric piano in the processing of Step S51, the processing of the following Steps S54 and S55 is executed as the processing of an electric piano.

In Step S54, the CPU 21 determines whether the first switch 34 is OFF. The specific processing is similar to that of Step S52. Therefore, the processing of an electric piano enters a standby state by the determination processing of Step S54 being repeatedly executed during a time until the OFF signal from the first switch 34 is outputted. Then, when the OFF signal from the first switch 34 is outputted, in Step S54, it is determined that the first switch 34 is OFF, and the processing advances to Step S55.

In Step S55, the CPU 21 executes a sound attenuation instruction. The specific processing is similar to that of Step S53. When the processing of Step S55 ends, the CPU 21 ends the processing of key-releasing.

Processing of Electric Organ

Next, the processing of an electric organ is described.

In a case in which the kind of tone is determined to be an electric organ in the processing of Step S51, the processing of the following Steps S56 to S59 is executed as the processing of an electric organ.

With reference to FIG. 10, in Step S56, the CPU 21 determines whether the second switch 35 is OFF. More specifically, the CPU 21 determines whether the OFF signal from the second switch 35 has been detected, the signal of which is outputted when the key 32 is pressed and returns to the position x2 (refer to FIG. 4) so that the second contact 35*a* separates from the second switch substrate 43. In a case in which this determination is Yes, the CPU 21 advances the processing to Step S57, and in a case in which this determination is No, the CPU 21 returns the processing to Step S56.

Therefore, in Step S56, until the second switch 35 is determined to be OFF, the CPU 21 repeatedly executes the determination processing of Step S56. Then, when the second switch 35 is determined to be OFF, the CPU 21 advances the processing to Step S57.

In Step S57, the CPU 21 executes an instruction to attenuate a low pitch feet sound. More specifically, the CPU 21 supplies a Note-off-Event indicating a pitch of a musical sound to be attenuated to the sound source unit 26 and instructs to attenuate a musical sound of the pitch indicated by the Note-off-Event.

In Step S58, the CPU 21 determines whether the first switch is OFF. The specific processing is similar to that of Step S52. Therefore, the processing of an electric piano enters a standby state by the determination processing of Step S58 being repeatedly executed during a time until the OFF signal from the first switch 34 is outputted. Then, when the OFF signal from the first switch 34 is outputted, in Step S58, it is determined that the first switch 34 is OFF, and the processing advances to Step S59.

In Step S59, the CPU 21 executes an instruction to attenuate a high pitch feet sound. More specifically, the CPU 21 supplies a Note-off-Event indicating a pitch of a musical sound to be attenuated to the sound source unit 26 and instructs to attenuate a musical sound of the pitch indicated by the Note-off-Event. When the processing of Step S59 ends, the CPU 21 ends the processing of key-releasing.

Processing of Harpsichord

Next, the processing of a harpsichord is described.

In a case in which the kind of tone is determined to be a harpsichord in the processing of Step S51, the processing of the following Steps S60 to S63 is executed as the processing of a harpsichord.

In Step S60, the CPU 21 determines whether the second switch is OFF. The specific processing is similar to that of Step S56. Therefore, the processing of a harpsichord enters a standby state by the determination processing of Step S60 being repeatedly executed during a time until the OFF signal from the second switch 35 is outputted. Then, when the OFF signal from the second switch 35 is outputted, in Step S60, it is determined that the second switch 35 is OFF, and the processing advances to Step S61.

In Step S61, the CPU 21 executes an instruction to generate a sound of a plectrum touching a string. The reason for executing the present processing is that a harpsichord has plectrums working together with a keyboard, and a sound is generated by a plectrum striking a string upon key-pressing, and furthermore, a sound is generated again by the plectrum returning to touch a string upon key-releasing. More specifically, the CPU 21 supplies a Note-on-Event indicating a pitch of a musical sound to be generated to the sound source unit 26. The sound source unit 26 reads waveform data of the ROM 22 based on a pitch and the kind of tone determined in Step S21 so as to generate musical sound data. In this way, a musical sound is generated from the speaker 28. It should be noted that, in Step S61, a sound volume may be controlled in consideration with a velocity upon key-releasing.

In Step S62, the CPU 21 determines whether the first switch is OFF. The specific processing is similar to that of Step S52. Therefore, the processing of a harpsichord enters a standby state by the determination processing of Step S62 being repeatedly executed during a time until the OFF signal from the first switch 34 is outputted. Then, when the OFF signal from the first switch 34 is outputted, in Step S62, it is determined that the first switch 34 is OFF, and the processing advances to Step S63.

In Step S63, the CPU 21 executes a sound attenuation instruction. The specific processing is similar to that of Step S53. When the processing of Step S63 ends, the CPU 21 ends the processing of key-releasing.

An electric keyboard musical instrument 10 of the present embodiment includes: keys 32; third switches 36 that detect that the keys 32 are pressed down to a position x3; various switches 12 to 15 that receive a selection of a kind of tone; and a CPU 21 that executes generating a sound with a tone of the kind received by various switches 12 to 15 in response to the third switch 36 detecting that a key 32 is pressed down to a position x3. The CPU 21 changes a time from when the third switch 36 detects that a key 32 is pressed down to position x3 until sound generation is executed, according to a kind of tone received through the various switches 12 to 15.

With such a configuration, it is possible to reflect the characteristics of a keyboard mechanism of a plurality of actual keyboard musical instruments with a single electric keyboard musical instrument.

Furthermore, the electric keyboard musical instrument 10 includes a table that stores sound generation delay times for each kind of tone, and the CPU 21 retrieves a sound generation delay time corresponding to a kind of tone received by the various switches 12 to 15 and determines a time until sound generation is executed based on the sound generation delay time thus retrieved.

With such a configuration, it is possible to realistically reproduce the difference of a latency time of sound generation between an acoustic piano and an electric piano, for example.

Furthermore, the electric keyboard musical instrument 10 according to the present embodiment further includes the second switch 35 that detects that the key 32 is pressed down to the position x2 and the CPU 21 that executes generating a sound in response to the key 32 having been pressed down to the position x2 in a case in which the tone received is an electric organ.

With such a configuration, it is possible to reflect the characteristics of a keyboard musical instrument in which a sound starts to be generated with a smaller key-pressing rate as with an actual organ, compared to a piano.

It should be noted that the present invention is not to be limited to the aforementioned embodiment, and that various modifications, improvements, etc. within a scope that is described in the claims are also included in the present invention.

It should be noted that, in the present specification, the steps describing the program recorded in the storage medium include not only processing executed in a time series following this order, but also processing executed in parallel or individually, which is not necessarily executed in a time series.

Although some embodiments of the present invention have been described above, the embodiments are merely exemplifications, and are not to limit the technical scope of the present invention. For example, the kind of tone described in the present embodiments may include strings, guitar, pipe organ, etc. Various other embodiments can be employed for the present invention, and various modifications such as omissions and replacements are possible without departing from the spirits of the present invention. Such embodiments and modifications are included in the scope of the invention and the summary described in the present specification, and are included in the invention described in the claims as well as the equivalent scope thereof.

What is claimed is:

1. An electric keyboard musical instrument comprising:

a keyboard including a plurality of keys;

a detection unit that detects that any one of the plurality of keys has been pressed;

a selection unit that selects a tone of a musical sound to be generated from among a plurality of tones;

a determination unit that determines a sound generation delay time from among a plurality of sound generation delay times, in accordance with the tone selected by the selection unit; and a sound generation instruction unit that instructs a sound source to generate a musical sound of the tone selected by the selection unit, after the lapse of the sound generation delay time determined by the determination unit from a time at which pressing of a key was detected by the detection unit;

wherein the detection unit is configured such that:

in a case in which a predetermined tone is selected by the selection unit, pressing of a key is detected when the key is pressed to a first position; and in a case in which a tone other than the predetermined tone is selected by the selection unit, pressing of a key is detected when the key is pressed to a second position.

2. The electric keyboard musical instrument according to claim 1, further comprising:

a table that stores sound generation delay times for each of the plurality of tones, wherein the determination unit includes a retrieval unit that retrieves, from the table, a sound generation delay time corresponding to the tone selected by the selection unit.

3. A method executed by an electric keyboard musical instrument including a plurality of keys, the method comprising:

detecting that any one of the plurality of keys has been pressed;

selecting a tone of a musical sound to be generated from among a plurality of tones;

determining a sound generation delay time from among a plurality of sound generation delay times, in accordance with the selected tone; and instructing a sound source to generate a musical sound of the selected tone, after the lapse of the determined sound generation delay time from a time at which pressing of a key was detected;

wherein the detecting is performed such that:

in a case in which a predetermined tone is selected, pressing of a key is detected when the key is pressed to a first position; and in a case in which a tone other than the predetermined tone is selected, pressing of a key is detected when the key is pressed to a second position.

4. The method according to claim 3, wherein the electric keyboard musical instrument further includes a table that stores sound generation delay times for each of the plurality of tones, and the determining comprises retrieving, from the table, a sound generation delay time corresponding to the selected tone.

5. A non-transitory computer-readable storage medium storing a computer-readable program that enables a computer used as an electric keyboard musical instrument having a keyboard including a plurality of keys to execute functions comprising:

detecting that any one of the plurality of keys has been pressed;

selecting a tone of a musical sound to be generated from among a plurality of tones;

determining a sound generation delay time from among a plurality of sound generation delay times, in accordance with the selected tone; and instructing a sound source to generate a musical sound of the selected tone, after the lapse of the determined sound generation delay time from a time at which pressing of a key was detected;

wherein the detecting is performed such that:

in a case in which a predetermined tone is selected, pressing of a key is detected when the key is pressed to a first position; and in a case in which a tone other than the predetermined tone is selected, pressing of a key is detected when the key is pressed to a second position.

6. The storage medium according to claim 5, wherein the electric keyboard musical instrument further includes a table that stores sound generation delay times for each of the plurality of tones, and the determining comprises retrieving, from the table, a sound generation delay time corresponding to the selected tone.

* * * * *